United States Patent [19]

Jordan, Jr.

[11] 4,147,276

[45] Apr. 3, 1979

[54] RETAINER DEVICE MEANS FOR HINGING OR REMOVABLY ATTACHING A COVER TO A CHASSIS

[75] Inventor: William D. Jordan, Jr., Woodland Hills, Calif.

[73] Assignee: Canoga Controls Corporation, Canoga Park, Calif.

[21] Appl. No.: 837,901

[22] Filed: Sep. 29, 1977

[51] Int. Cl.[2] ..... B65D 45/28

[52] U.S. Cl. ..... 220/323; 220/326; 220/337

[58] Field of Search ..... 220/315, 323, 326, 337; 24/73, 195; 16/180, 149, 181

[56] References Cited

U.S. PATENT DOCUMENTS 1,618,145 2/1927 Borglum ..... 220/323

1,974,539 7/1933 Comte ..... 220/323 X

*Primary Examiner*—George T. Hall

*Attorney, Agent, or Firm*—Freilich, Hornbaker, Wasserman, Rosen & Fernandez

[57] ABSTRACT

Means for hinging or removably attaching a cover to a chassis comprising a retainer device including a pair of arms spring-urged away from one another. The retainer device is fixed to the chassis with the ends of the arms extending outward into openings in the cover. The arms can be manually pinched to disengage them from the cover openings to thereby permit the cover to be removed from the chassis. Utilization of a pair of retainer devices on the chassis enables one of the devices to be disengaged while the other remains engaged to thus hinge the cover relative to the chassis.

8 Claims, 5 Drawing Figures

RETAINER DEVICE MEANS FOR HINGING OR REMOVABLY ATTACHING A COVER TO A CHASSIS

BACKGROUND OF THE INVENTION

This invention relates to fastening devices and more particularly to a retainer device useful for hinging or removably attaching a protective housing cover to an electronic chassis unit.

Generally, a cover is secured to an electronic chassis by screws which pass through holes or slots in the cover and into tabs or brackets mounted on the chassis. This arrangement is relatively expensive and inconvenient in that special tabs must be fabricated and mounted to the chassis and multiple screws must be repeatedly screwed in and out during the sequence of assembly, test, rework, retest, etc., before final shipment of the equipment.

Other problems with such prior art fastening techniques occur when servicing the chassis in the field. Servicing is time-comsuming since repair personnel are required to remove multiple screws to gain access to the electronic components carried by the chassis. In addition, the housing cover must be completely removed from the chassis and set aside in order to service the unit, thus increasing the likelihood of damaging or marring the cover.

SUMMARY OF THE INVENTION

The present invention is directed generally to improved means suitable for attaching a housing cover to a chassis and more particularly to a reliable inexpensive retainer device which can be manually disengaged without tools to allow rapid easy access to the electronic components carried by the chassis.

A preferred retainer device in accordance with the present invention comprises a wire or plastic spring secured to the chassis and formed with two arms extending substantially parallel to one another but spring-urged away from one another. The free ends of the arms extend in opposite directions so as to engage openings in the housing cover to secure the cover to the chassis. The arms can be manually squeezed together to thereby disengage the free ends thereof from the openings in the housing cover. The cover may then be removed from the chassis to thus provide access to any electronic components mounted on the chassis.

In accordance with one feature of the preferred embodiment, the arms of the retainer device are formed to define finger loops to facilitate their being manually pinched.

In accordance with a further feature of the invention, it is generally preferred that two spaced retainer devices be used to attach the cover to the chassis. By so doing, one of the devices can be disengaged leaving the other device engaged to act as a hinge to permit the cover to be swung away from the chassis to provide access. Alternatively, both devices can be disengaged to permit the cover to be removed from the chassis.

DESCRIPTION OF THE PREFERRED EMBODIMENTS

Figure 1:
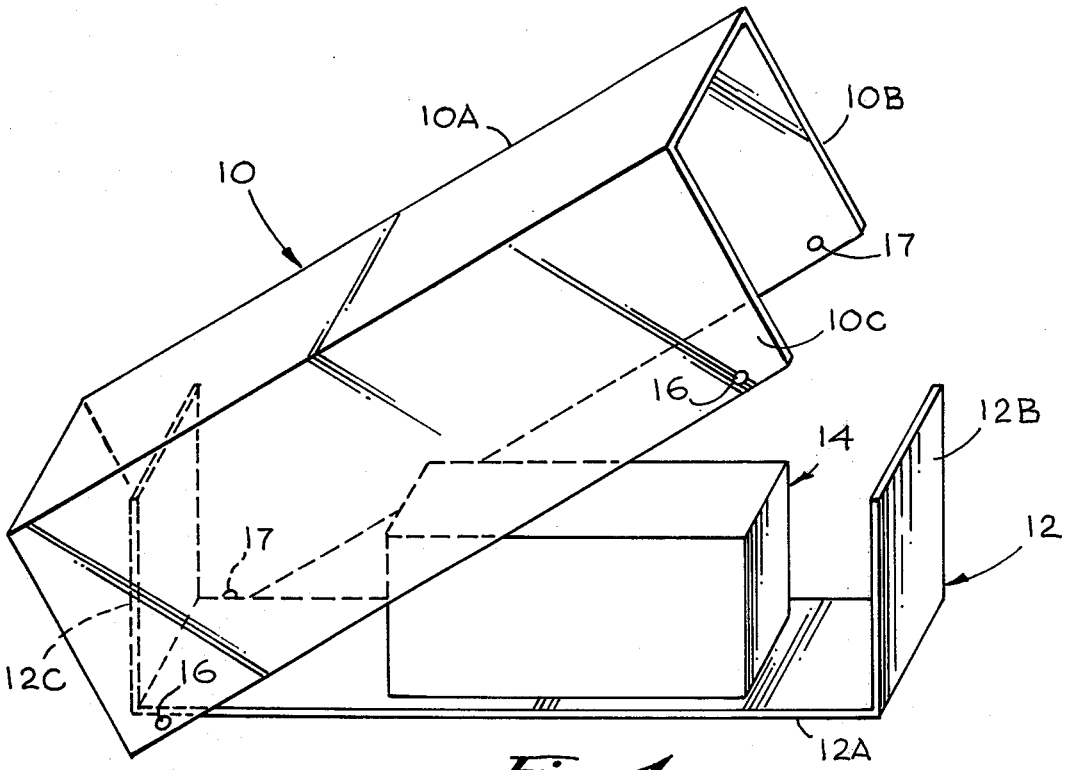
FIG. 1 is an isometric view illustrating the chassis and housing cover in hinged relationship.

Attention is now called to FIG.1 which illustrates a typical protective housing cover 10 intended to be secured to a chassis 12 carrying electronic components 14. When in operative condition, the cover 10 is intended to be secured to the chassis 12 so as to fully envelope and protect the components 14 carried by the chassis. Chassis 12 is U-shaped and comprises a bottom member 12A upon which components 14 are mounted, and two end members 12B, 12C. Housing cover 10 is U-shaped and comprises a top member 10A and side members 10B, 10C. The present invention is directed to means which can be engaged to secure the cover 10 in closed operative condition on the chassis 12 or which can be manually disengaged to permit the cover 10 to be selectively removed from, or swung upwards in an arc away from the chassis 12 to provide access to electronic components 14 carried thereby. Foam or other elastic material (not shown) is preferably inserted between the upper edges of chassis members 12B, 12C and the inside of cover top member 10A to enhance the "firmness" therebetween.

Figure 2:
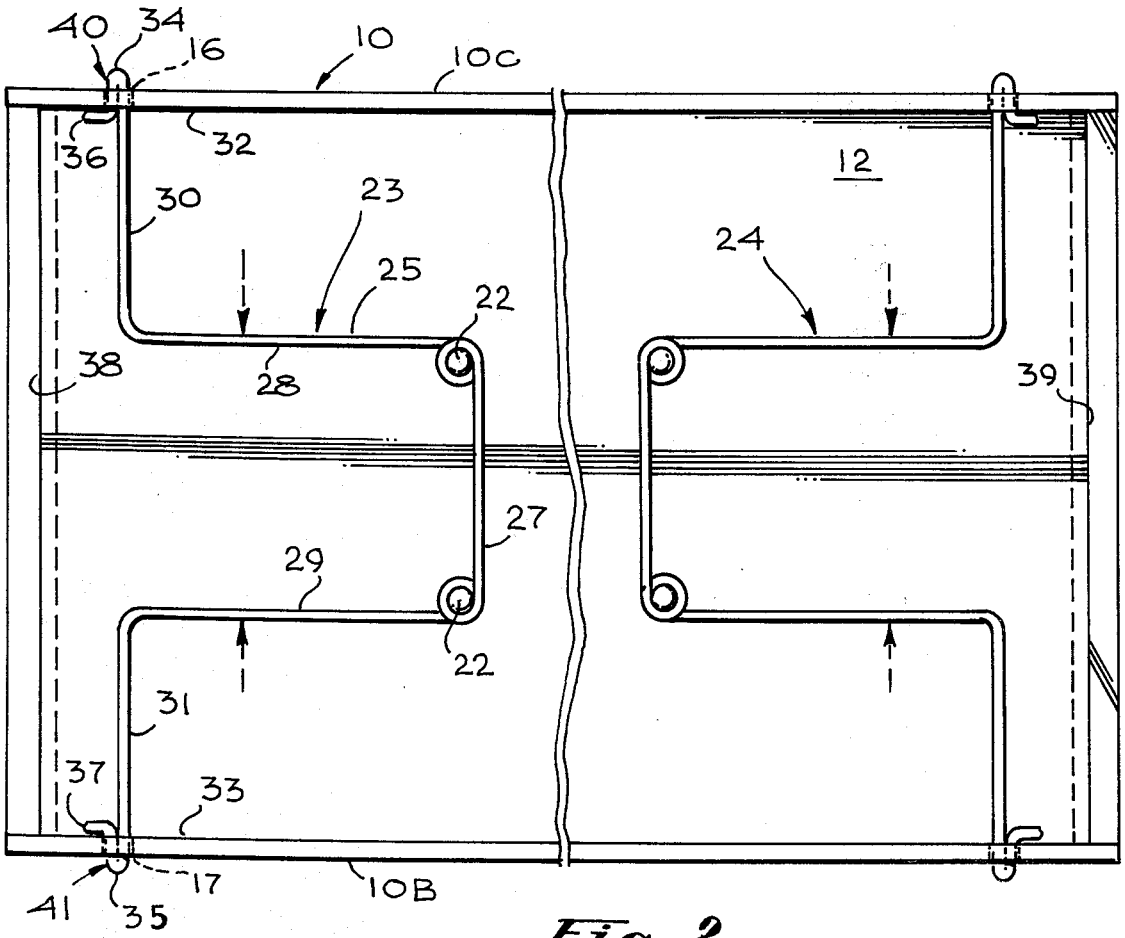
FIG. 2 is a bottom plan view of the chassis incorporating a retainer device in accordance with the invention.

FIG. 2 is a bottom plan view of chassis 12 showing a pair of retainer devices 23, 24 fixed to the undersurface of the chassis. Each retainer device is formed of a single wire of spring material 25 surrounding one or more fasteners 22, such as standard rivets, secured to the undersurface of chassis 12. The single wire spring 25 surrounds both rivets 22 to form a bight portion 27 and a pair of substantially parallel arms 28, 29 which are spring urged away from each other. The free ends 30, 31 of arms 28, 29 curve outwrdly approximately 90° toward opposite edges 32, 33 of the chassis. Free ends 30, 31 extend past edges 32, 33 of the chassis and wrap back to form smooth rounded exterior surfaces 34, 35. Formed surfaces 34, 35 of wire spring 25 prevent potential injuries which might result from exposing sharp and pointed extremities 36, 37 of free ends 30, 31 beyond the chassis edges 32, 33. The extremities 36, 37 of free ends 30, 31 bend outwardly toward edge 38 of chassis 12 to form hooks 40, 41. The formed surfaces 34, 35 of free ends 30, 31 are adapted to protrude through and engage openings 16, 17 in housing cover 10 to thus secure the protective housing cover 10 to the chassis 12. Extremities 36, 37 act as limit stops to prevent the surfaces 34, 35 from protruding an unnecessary distance past the outer faces of cover members 10B, 10C. The tension of the wire spring 25 urges the two free ends 30, 31 away from one another and into engagement in the openings 16, 17. In order to disengage a retainer device from the cover 10, the arms 28, 29 may be manually pinched together to remove the free ends 30, 31 from the openings 16, 17 in the cover 10.

Although a single retainer device can be used, it is preferred that two retainer devices 23, 24 be used to attach the protective housing cover 10 to the chassis 12 as illustrated in the embodiment of FIG. 2. In this embodiment, either retainer device may be disengaged while the other remains engaged to permit the cover 10 to pivot around the free ends 30, 31 of the engaged retainer device. The advantage of this embodiment is that either end of chassis 12 may be swung free of housing cover 10. Should both retainer devices 23, 24 be disengaged, the entire chassis 12 may be removed from protective housing cover 10.

Figure 3:
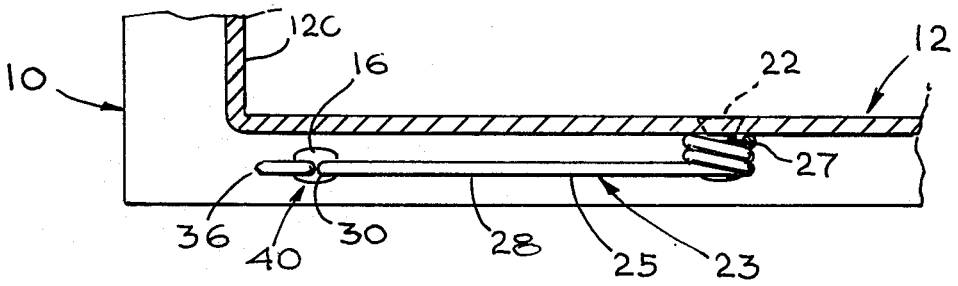
FIG. 3 is a sectional view taken substantially through one of the spring retainer devices of FIG. 1.

In FIG. 3, the retainer device 23 is depicted in a sectional side view showing the single wire spring 25 surrounding and secured by rivet 22 to the underside of chassis 12. The free end of wire spring 25 is shown engaged in opening 16 of housing cover 10. Further protrusion of free end 30 is prohibited by the contact between extremity 36 of the hooked segment 40 and that portion of housing cover 10 surrounding opening 16.

Figure 4:
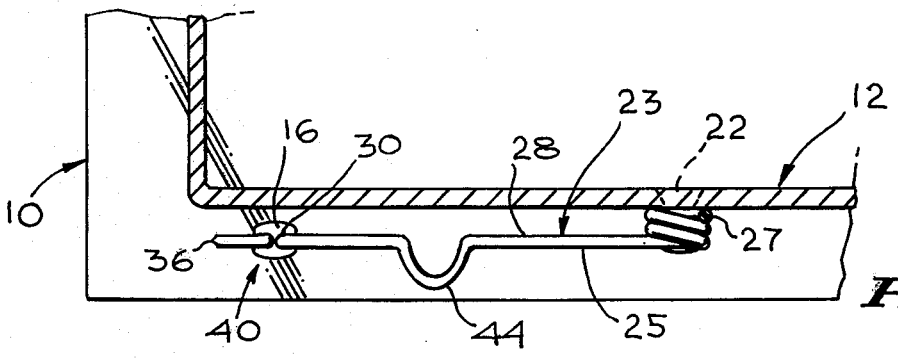
FIG. 4 is a sectional view of an alternative retainer device in accordance with the invention.

A further feature of the preferred embodiment is illustrated in FIG. 4. A section of the arms 28, 29 of retainer device 23 is formed so as to define finger loops. Each finger loop 44 consists of a raised inverted U-shaped segment. The finger loops 44 are designed to enable the arms of the retainer devices to be more easily pinched together to disnegage the ends 30, 31 of wire spring 25 from housing cover 10.

In an alternate embodiment of the invention (not shown), a single retainer device can be used. In place of the second retainer device, fixed tabs or pins can be provided projecting outwardly from the chassis edges 32, 33. The tabs or pins can project into openings in the housing cover 10 to function as a hinge around which chassis 12 can swing when not secured by the single retainer device.

Figure 5:
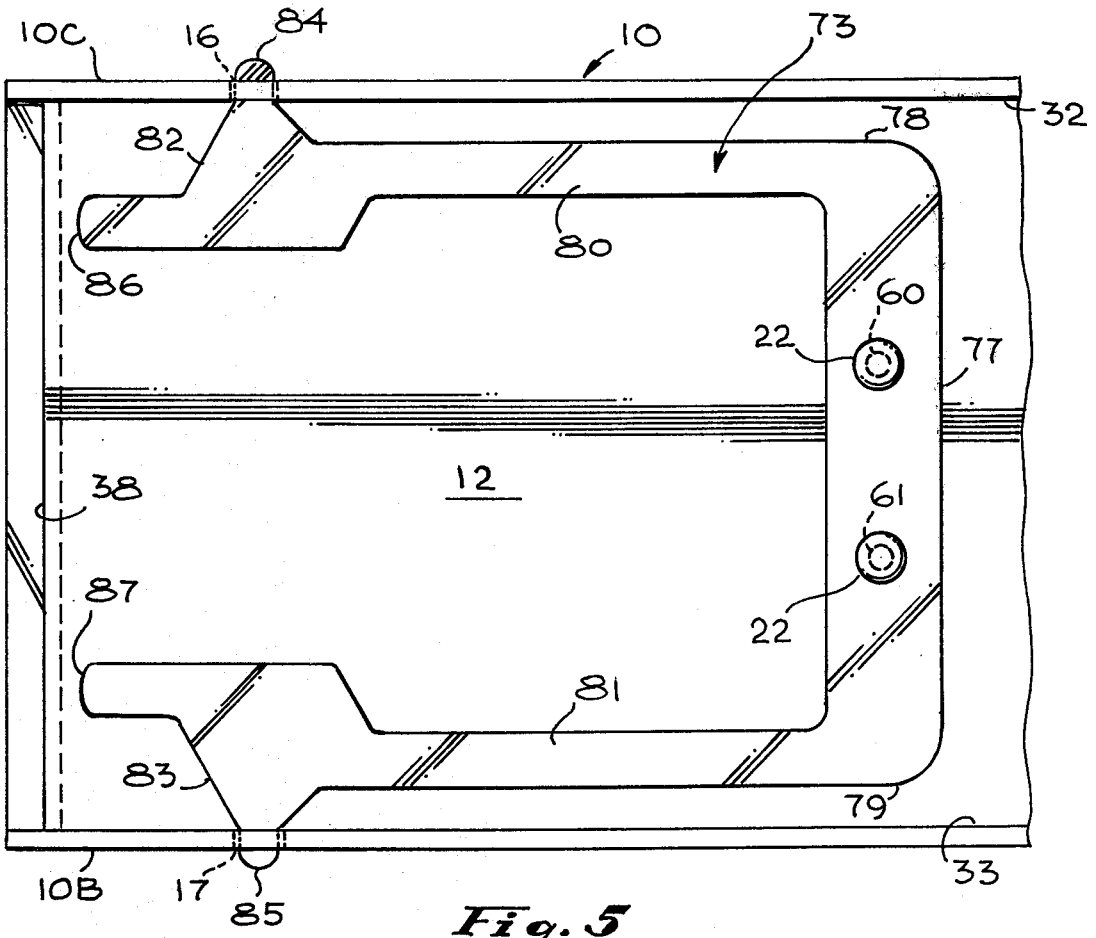
FIG. 5 is a bottom plan view of the chassis incorporating an alternate embodiment of the present invention.

Another embodiment of the present invention is illustated in FIG. 5. Rather than being comprised of a wire spring, retainer device 73 comprises a U-shaped unitary member formed of a suitable plastic material and having a uniform thickness on the order of less than 0.1 inches. The middle portion of retainer device 73 forms a bight 77 extending almost the full width of chassis 12 between chassis edges 32 and 33. Centered along the longitudinal axis of bight portion 77, two holes 60, 61 are located equidistantly from the ends 78, 79 of bight 77. Arms 80, 81 extend perpendicularly in the same direction from bight portion 77 and are substantially parallel to one another. Formed on opposite side 82, 83 of arms 78, 79 are two smooth rounded protuberances 84, 85, each of which points outwardly from and is directly opposite the other. The two extremities 86, 87 of arms 80, 81 are recessed inwardly from chassis edges 32, 33. Instead of having elevated surfaces defining finger loops, the two extremities 86, 87 lie in the same plane as the other portions of retainer device 73. The retainer device 73 is secured to the undersurface of chassis 12 by fasteners 22, such as standard rivets, which pass through holes 60, 61 located in the bight portion 77 of the retainer. When retainer device 73 is secured to chassis 12, protuberances 84, 85 extend beyond chassis edges 32, 33 and engage openings 16, 17 in sides 10B, 10C of housing cover 10. The elasticity of the plastic material forming retainer device 73 permits the disengagement of the two protuberances 84, 85 from housing cover 10 by manually squeezing the two arms 80, 81 together at their extremities 86, 87.

Although particular embodiments of the invention have been described and illustrated herein, it is recognized that modifications and variations may readily occur to those skilled in the art and, consequently, it is intended that the claims be interpreted to cover such modifications and equivalents.

What is claimed is:

1. Fastening means for removably attaching a housing cover to a chassis carrying electronic components, comprising:

a retainer device secured to said chassis and including a pair of substantially parallel arms spring-urged away from one another;

said housing cover having openings therein disposed opposite one another in substantial alignment;

said chassis and housing cover being oriented relative to one another such that portions of said arms project into said housing cover openings to thus fasten said cover to said chassis.

2. The fastening means as in claim 1 wherein said retainer device is comprised of a single continuous wire.

3. The fastening means as in claim 2 further including means on said arms for engaging said cover to limit the distance said arms project into said cover openings.

4. The fastening means as in claim 1 wherein said arm portions projecting into said housing cover openings wrap back upon themselves to form smooth surfaces.

5. The fastening means as in claim 1 wherein each of said arms is elongated and shaped to include a portion extending substantially perpendicular to said elongation to form finger loops.

6. The fastening means as in claim 1 wherein said retainer device is formed of a plastic material.

7. Fastening means for removably attaching a housing cover to a chassis carrying electronic components comprising:

a pair of retainer devices secured in spaced relationship to said chassis, each retainer device including a pair of substantially parallel arms spring-urged away from one another;

said housing cover having openings therein disposed opposite one another in substantial alignment;

said chasis and housing cover being oriented relative to one another such that portions of said arms project into said housing cover openings to thus fasten said cover to said chasis.

8. The fastening means of claim 7 wherein said arm portions are dimensioned so as to be rotatable in said openings to thus enable one of said retainer devices to be disengaged and the cover pivoted relative to said chassis.

* * * * *